US007305922B2

(12) United States Patent
Kandlbinder

(10) Patent No.: US 7,305,922 B2
(45) Date of Patent: Dec. 11, 2007

(54) PRINTING BLANKET HAVING A RIGID CARRIER PLATE

(75) Inventor: Thomas Kandlbinder, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 371 days.

(21) Appl. No.: 11/014,398

(22) Filed: Dec. 16, 2004

(65) Prior Publication Data

US 2005/0166778 A1 Aug. 4, 2005

(30) Foreign Application Priority Data

Dec. 19, 2003 (DE) ..... 103 60 015

(51) Int. Cl.
*B41N 10/04* (2006.01)

(52) U.S. Cl. ..... 101/375; 101/376; 101/217

(58) Field of Classification Search ..... 101/375, 101/376, 377, 401.1, 217, 378, 415.1
See application file for complete search history.

(56) References Cited

U.S. PATENT DOCUMENTS 6,530,321 B2 * 3/2003 Andrew et al. ..... 101/376
2005/0098051 A1 * 5/2005 Flint et al. ..... 101/217
2005/0241503 A1 * 11/2005 Hoffmann et al. ..... 101/217

FOREIGN PATENT DOCUMENTS

DE 195 43 584 C1 7/1997
DE 200 07 227 U1 6/2001
DE 101 17 409 A1 10/2002

OTHER PUBLICATIONS

Search report of German Patent Application 103 60 015.9, date unknown.

* cited by examiner

*Primary Examiner*—Daniel J. Colilla
*Assistant Examiner*—Kevin D. Williams
(74) *Attorney, Agent, or Firm*—Leydig, Voit & Mayer, Ltd

(57) ABSTRACT

A printing blanket comprising a rigid carrier plate on which an elastic layer is arranged is provided. The elastic covering layer has a surface that can be inked and by which a printing image can be transferred onto a printing material. An end of the carrier plate is not covered by the elastic covering layer, and an end of the elastic covering layer is covered by a sealant. The sealant covered end of the elastic covering layer has a sealing geometry that provides a greater surface area to which the sealant can adhere than a smooth flat surface at the end of the elastic covering layer.

6 Claims, 1 Drawing Sheet

PRINTING BLANKET HAVING A RIGID CARRIER PLATE

FIELD OF THE INVENTION

The present invention generally relates to a printing blanket having a rigid carrier plate on which at least one elastic layer is arranged with a surface that can be inked in order to transfer a printing image to a printing-material web.

BACKGROUND OF THE INVENTION

In offset printing presses, in particular web-fed offset rotary printing presses, the images to be printed are transferred by a form cylinder onto an offset cylinder, which is usually referred to as a rubber blanket cylinder. The image is then transferred from the rubber blanket cylinder onto a printing material. In the past, printing blankets consisting of a multi-layer construction, which are commonly referred to as rubber blankets, were predominantly clamped on the rubber blanket cylinder with the ends of the rubber blanket fixed in the cylinder channel. This type of rubber blanket typically has a thickness of approximately 2 mm. Accordingly, an opening of at least 4 mm was necessary just to insert the two ends of the rubber blanket into the cylinder channel. As a rule, the width of the clamping channel of a rubber-covered cylinder had to be substantially larger due to various factors in order to be able to change the rubber blankets during operation without disturbances.

A rubber blanket, in which the flexible layers are arranged on a rigid flexible carrier is disclosed in WO 01/70 512 A1. In particular, the rubber layers of the blanket have corresponding reinforcements comprising a textile, a covering layer (i.e., a printing layer) and customarily a compressible layer. The carrier is customarily a metal plate. For reasons of cost, a steel plate is frequently used. The rubber-layer construction is typically fixed to the steel plate, particularly adhesively bonded to the steel plate. As described, this construction comprises at least one covering layer whose surface holds the printing image. This surface can consist of, for example, an elastomeric material. It is advantageous, but not necessarily required, to provide a woven-fabric layer below the covering layer. A layer of compressible material that can contain air inclusions is customarily used below the woven-fabric layer. This layer construction can be fixed to the carrier plate by an adhesion promoter. The leading and trailing ends of the plate are not covered by the rubber-layer construction. As a result, only the thin steel sheets have to be inserted into the cylinder channel and fastened in the channel. The result of this is a substantial reduction in the channel width, which has substantial advantages, as is known. In the rubber blanket according to WO 01/70512 A1, the ends of the rubber layer are therefore opposite one another above the cylinder channel.

A printing blanket, in which the rubber layer, like the printing blanket described above also has a layer construction consisting of a plurality of layers is disclosed in DE 101 17 409 A1. This layer construction is sealed at the two ends of the printing blanket. The sealant extends over the overall height of the material thickness of the rubber-blanket-layer construction. Moreover, as a result of its approximately triangular cross section, the sealant partially covers the free ends of the metal layer (i.e. of the sheet-metal plate) that are to be inserted into the cylinder channel. This arrangement prevents, in particular, fluids used during the printing process and also washing fluids from penetrating into the woven-fabric inlay or penetrating below the uppermost layer and impairing the intimate assembly of the layer construction. In this known rubber blanket, it is considered advantageous for the thickness of the elastomeric coating sealant to be increased continuously in the direction of the metal plate. As a result, a significantly large area of the elastomeric coating is produced above the rubber-covered plate or above an adhesion-promoter layer used on the rubber-covered plate. This measure is intended to counteract tangential forces that are produced, in particular, at the base point of the printing blanket, namely in the transition region of the elastomeric coating or of the sealant.

The known metallic backed rubber blankets described above have the disadvantage that their service life is considerably less than the service life of conventional rubber blankets not having a metal plate. However, the sealing of the printing blanket surface as far as the steel sheet described above ensures complete sealing.

BRIEF SUMMARY OF THE INVENTION

It has been recognized that a frequent cause of failure of rubber blankets including metal carrier plates is that the sealant detaches itself from the covering layer of the printing blanket. Moreover, it has been recognized that this detachment is caused by the methods of applying sealant in the form of thin layers in the vicinity of the covering layer that are currently employed. Pronounced shearing and compressive forces occur in the area of the covering layer as a result of deformation of the metallic backed rubber blanket that is caused by being rolled over by the cylinder. In view of this problem, which has been recognized and analyzed for the first time, an object of the present invention is providing a printing blanket having a rigid carrier plate that does not have the disadvantages described above and that, in particular, has a longer service life than the printing blankets of this type. In particular, the service life of metallic backed printing blankets according to the invention ideally approach the service life of conventional rubber blankets.

DETAILED DESCRIPTION OF THE INVENTION

Figure 1:
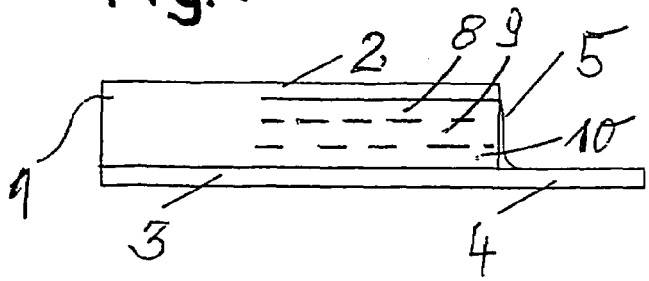
FIG. 1 is a schematic side view of a rubber printing blanket with a rigid carrier plate having a known construction.

Referring now to the drawings, FIG. 1 illustrates diagrammatically the basic construction of a known rubber printing blanket having a metal or metallic carrier plate which, with regard to the layer construction, can also be used in the printing blankets according to the invention. However, as will be appreciated by those skilled in the art, a different layer construction with a larger or smaller number of individual layers can also be used within the context of the invention.

The metallic backed rubber printing blanket 1 of FIG. 1 comprises at least one covering layer 2. The covering layer 2 represents the printing layer, as its surface can be inked with the printing image in order to transfer the printing images onto a printing material (not shown). A metal plate 3 is shown on the lower side of the metallic backed rubber blanket 1. Only the right-hand section of the rubber blanket 1 is shown. The plate end 4 of the metal plate 3, which preferably is a steel plate, is not provided with the rubber layer and thus can be fixed in the clamping channel of a blanket cylinder together with the second end (not shown) of the metal plate 3. Except for the plate ends, the metal plate 3 is provided with a multi-layer construction. In addition to the covering layer 2, the multi-layer construction can include a non-expandable layer (e.g., a woven-fabric layer 8), a compressible layer 9 having air inclusions, and an adhesive layer (e.g., an adhesive 10).

As shown in FIG. 1, in known rubber blankets, the sealant 5 is very thin, in particular in the upper region of the multi-layer construction. This is true, in particular, in the area of the end of the covering layer 2. As a result, problems can occur. In particular, there is a risk that the covering layer 2 can detach itself from the layers lying underneath or, in some circumstances in the event of a partial detachment, there is a risk of dampening solution or the like penetrating the multi-layer construction.

Accordingly, a particular aspect of the present invention involves removing the risk of the sealant detaching from the covering layer. To this end, the sealant geometry is optimized to the extent that the area for adhesion to the printing blanket is increased with simultaneous minimization of the stress applied to the sealant. In the simplest case, this can be achieved by increasing the adhesive area of the sealant 5, in particular at the covering layer 2. A substantially greater adhesive area or adhesive-area geometry is produced by a roughening process in comparison with a smooth, i.e. not roughened layer, as is produced, for example, by a cut. Such a roughening process improves the adhesion of the sealant, in particular on the covering layer. As a result, it is possible to avoid the described problems and, in particular, the service life of the printing blanket with rigid carrier plates can be increased.

Figure 2:
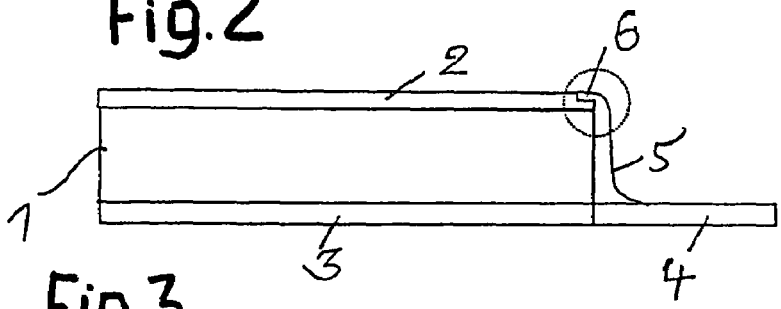
FIG. 2 is a schematic side view of an exemplary rubber printing blanket with a rigid carrier plate constructed according to the present invention.

As shown in FIG. 2, the increase of the area for adhesion to the printing blanket can be achieved by selecting a step shape that extends transversely over the metallic printing blanket at the end of the covering layer 2 as the sealant geometry 6. As further shown in FIG. 2, a substantially larger area for adhesion to the covering layer 2 is available to the sealant 5 as a result of using the step shape as the sealant geometry 6 at the end (e.g., at the leading end of the metallic backed rubber blanket) in comparison with a planar cut or a flat end of the covering layer in accordance with the known arrangements (cf. FIG. 1). This increase in the adhesive area between the covering layer 2 and sealant 5 substantially reduces the risk of the sealant detaching from the covering layer 2. As a result, the service life of the rubber blankets is correspondingly increased significantly.

Figure 3:
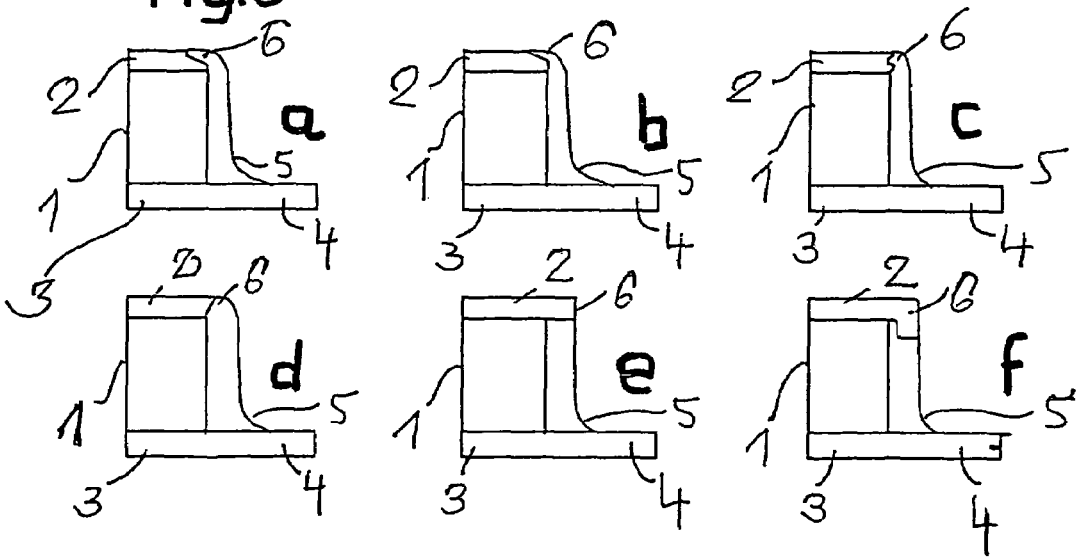
FIGS. 3*a-f* are schematic side views of various alternative embodiments of the ends of the covering layer of the blanket of FIG. 2.

FIGS. 3*a-f* illustrate various alternative shapes for the design of the ends of the covering layer 2. All the alternative shapes increase the adhesive area 6 and thus result in the abovementioned advantages. In comparison to FIG. 2, a sealant geometry 6 can be seen in FIG. 3*a* in which the lower region of the covering layer is slightly beveled although it provides a certain step shape. In FIG. 3*b*, the upper region of the covering layer 2 is slightly beveled, after which the lower part extends vertically.

FIG. 3*c* shows a corrugated or zigzag-shaped design of the end or the edge of the covering layer 2 as the sealant geometry 6. In FIG. 3*d*, a bevel in the covering layer 2 that protrudes beyond the layers lying underneath is used. This bevel likewise provides an increased adhesive area compared with a vertical end. Finally, FIGS. 3*e* and 3*f* show a covering layer 2 that protrudes beyond the layers lying underneath. Due to the overhang, a sealant geometry can be produced on the underside of the covering layer 2 that also can be configured to be large enough that sufficient adhesion is achieved. The covering layer 2 also has an overhang in the representation according to FIG. 3*f* and is at the same time configured to be approximately hook-shaped, with the result that a very considerable increase in the sealant geometry 6 adhesive area can be achieved.

All refinements of the ends of the covering layer 2 that increase the adhesive area provide the advantages according to the invention and it is left to one skilled in the art to decide how to configure the geometry for a particular case. Within the context of the invention, it is also possible to select completely different geometric configurations here, if those geometric configurations increase the adhesive area.

Figure 4:
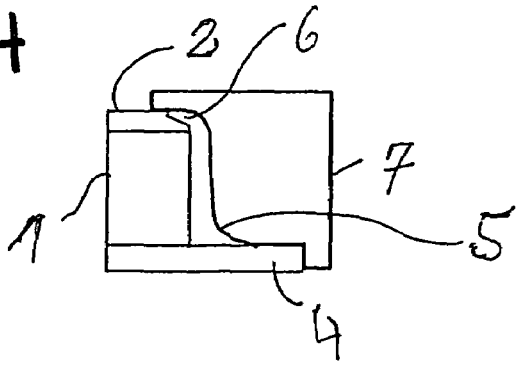
FIG. 4 is side view of an exemplary sealant stencil for manufacturing rubber printing blankets having rigid carrier plates according to the invention.

FIG. 4 shows a sealing geometry 6 that is similar to FIG. 3*b*. In order to apply the sealant 5 to the ends of the metallic backed rubber blanket 1 in an optimal manner, a shape stencil 7 is provided having a side (the left-hand side in FIG. 4) with a corresponding shape. The stencil shape can take into consideration how thickly the sealant 5 is to be applied overall and how it is to be adapted to the geometry of the end of the covering layer 2 that is configured according to the invention. FIG. 4 shows that it is advantageous to shape the sealant 5 with the shape stencil 7 in such a way that the sealant 5 terminates with the upper side of the covering layer 2 and extends with a sufficient width over the plate ends, in this case the plate end 4. It is also possible to select the thickness of the sealant 5 accordingly via the overall height, which can be seen in the lower step on the shape stencil 7.

Before the shape stencil 7 is used, a sufficient amount of the sealant 5 is applied manually or automatically over the metallic backed rubber blanket 1. The shape stencil 7 is then pulled transversely over the end region of the rubber-blanket layer structure, for example manually, as can be seen in FIG. 4. Of course, it is also possible to use shape stencils other than that shown in FIG. 4 to achieve the desired geometric shapes with a corresponding sealant-layer cover.

What is claimed is:

1. A printing blanket comprising a rigid carrier plate on which an elastic covering layer is arranged, said elastic covering layer having a surface that can be inked and by which a printing image can be transferred onto a printing material, a further layer arranged between said elastic covering layer and said carrier plate, said carrier plate having an end not being by the elastic covering layer and further layer, and said elastic covering layer end being covered by a sealant, having a sealing geometry that provides a greater surface area to which the sealant can adhere than a smooth flat end surface of the elastic covering layer, and said sealing geometry at the sealant covered end of the elastic covering layer comprising an extension of said elastic covering layer that protrudes beyond said further layer an underside of which adjoins said sealant.

2. A printing blanket according to claim 1, wherein the rigid carrier comprises a metal plate and said further layer comprises one woven fabric layer and one compressible layer are arranged between the elastic covering layer and the metal plate.

3. A printing blanket according to claim 1, wherein two free ends of the carrier plate are configured to be fixed in the clamping channel of an offset cylinder of a web-fed rotary offset printing press.

4. A printing blanket according to claim 1, wherein the sealing geometry at the sealant covered end of the elastic covering layer comprises a step-shaped configuration and the sealant covers the step in the covering layer and extends to a portion of the end of the carrier plate that is not covered by the elastic covering layer.

5. A printing blanket according to claim 1, wherein the sealing geometry at the sealant covered end of the elastic covering layer comprises a step-shaped configuration having has a perpendicular component and an obliquely extending component.

6. A printing blanket according to claim 1, wherein the sealing geometry at the sealant covered end of the elastic covering layer comprises a zigzag-shaped configuration.

* * * * *